United States Patent [19]

Chatterjea

[11] Patent Number: 4,530,376

[45] Date of Patent: Jul. 23, 1985

[54] PILOT VALVE INCLUDING A HYDRAULICALLY ACTUATED DETENT

[75] Inventor: Probir K. Chatterjea, Mt. Prospect, Ill.

[73] Assignee: Dresser Industries, Inc., Dallas, Tex.

[21] Appl. No.: 533,464

[22] Filed: Sep. 19, 1983

[51] Int. Cl.[3] ..... F15B 15/26; F15B 13/01

[52] U.S. Cl. ..... 137/636.1; 91/426; 74/471 XY; 137/596; 251/94

[58] Field of Search ..... 74/471 R, 471 XY, 527; 251/73, 297, 94; 137/636.1, 636.2, 596, 596.1, 596.14, 625.6; 91/426, 521, 522

[56] References Cited

U.S. PATENT DOCUMENTS

| | | | |
|---|---|---|---|
| 2,958,233 | 11/1960 | Johnson | 74/471 R |
| 3,301,136 | 1/1967 | Bolton et al. | 91/426 |
| 3,721,160 | 3/1973 | Kittle | 91/426 |
| 3,972,264 | 8/1976 | Field, Jr. | 91/358 A |
| 4,103,559 | 8/1978 | Kohler | 74/471 XY |
| 4,339,987 | 7/1982 | Stephenson et al. | 91/426 |
| 4,342,335 | 8/1982 | Reinicker et al. | 137/636.2 |
| 4,461,320 | 7/1984 | Barbagli | 91/426 |

*Primary Examiner*—George L. Walton

*Attorney, Agent, or Firm*—Barry E. Deutsch

[57] ABSTRACT

A pilot valve having a universally tiltable joy stick further includes a cam attached to said joy stick and movable therewith. A plunger is selectively movable into engagement with the cam for latching the joy stick in a selected one position. Fluid is supplied to the plunger for developing a force acting thereon to move the plunger into engagement with the cam. The fluid force is eliminated and the plunger disengaged from the cam to delatch the joy stick.

7 Claims, 3 Drawing Figures

PILOT VALVE INCLUDING A HYDRAULICALLY ACTUATED DETENT

BACKGROUND OF THE INVENTION

This invention relates to a pilot valve having a universally tiltable joy stick, and in particular to a hydraulically actuated detent for latching the joy stick in a selected one position.

In earth working equipment such as dozers, front-end loaders, cranes, and the like, it is conventional practice to provide hydraulic systems utilizing a pilot valve. The pilot valve generally includes a universally titlable joy stick having a cam attached thereto and movable therewith. In such art, it is conventional practice to provide a circular series of valves about the vertical axis through the cam, which, when the stems thereof are selectively depressed, flow of fluid is established to selectively actuate fluid motors for hoisting, swinging, controlling transmission, and other functions of the earth working equipment.

Very often, it is desired to hold the joy stick in a selected one position to maintain one of the valves open. For example, in a dozer, it is often desirable that the dozer blade be maintained in a "float" position. The gyratory movement of the joy stick and connected cam renders the use of a mechanical latch impractical.

Accordingly, it is an object of the present invention to provide a pilot valve having a detent for latching the joy stick of the valve in a selected one position wherein the detent does not interfere with the gyratory motion of the joy stick and connected cam, yet wherein the latching and delatching characteristics of the detent are positive and responsive.

SUMMARY OF THE INVENTION

The foregoing problem is solved according to the invention in a pilot valve including a universally tiltable joy stick, said valve comprising a valve housing; a circular series of valves arranged about a vertical axis through said housing; cam means attached to said joy stick and movable therewith; plunger means selectively movable into engagement with said cam means for latching said joy stick in a selected one position; hydraulically operated actuating means for moving said plunger means into engagement with said cam means including fluid supply means for developing a fluid force on said plunger means to move said plunger means into engagement with said cam means, valve means for controlling the flow of said fluid through said fluid supply means, and means for removing the fluid force acting on the plunger means; and plunger return means for disengaging said plunger means from said cam means upon removal of said fluid force for delatching said joy stick.

DESCRIPTION OF THE PREFERRED EMBODIMENTS

Figure 1:
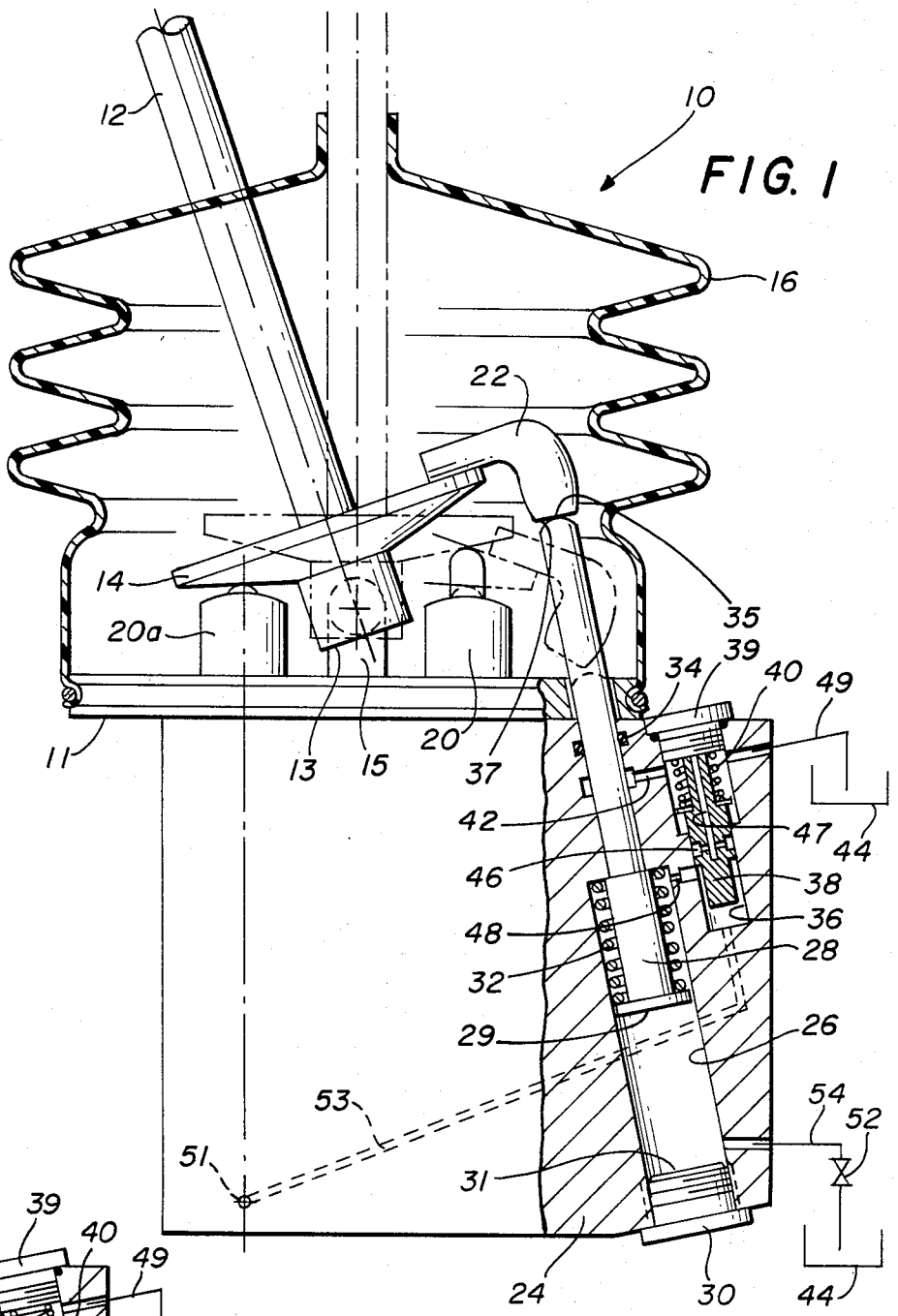
FIG. 1 is a vertical view of a pilot valve, partially in cross-section, and partially in schematic, incorporating the detent mechanism of the present invention.

Referring now to the various figures of the drawing, there is illustrated two embodiments of the present invention as incorporated in a pilot valve. Referring specifically to FIG. 1, pilot valve 10 includes valve housing 24. Housing 24 has generally circular ring 11 attached thereto. Flexible boot 16, made of rubber or rubber-like rubber-like material, is attached to ring 11. Boot 16 is corrugated as shown and is snuggly engaged with joy stick 12 to permit universal tilting movement of the joy stick. The boot prevents dirt and foreign matter from gaining entrance into housing 24 irrespective of the position of joy stick 12.

A circularly arranged series of valves 20 are mounted on ring 11. While only two of the valves are illustrated, in actual practice, four equally spaced valves 20 are typically provided. Valves 20 control the flow of fluid to various hydraulic motors controlling various functions of an earth working machine. Joy stick 12 extends upwardly from ring 11 and includes cylindrical end 13 in mating engagement with spherical socket 15 to provide the joy stick with a universal angular tilting motion.

Cam 14 is attached to the lower end of joy stick 12 and is movable therewith. As illustrated in FIG. 1, the cam may have an extension member 22 connected thereto for a reason to be more fully explained hereinafter. In FIG. 1, the phantom showing of the joy stick and connected cam represents the joy stick in a neutral position whereat valves 20 are all closed. The solid line representation of joy stick 12 and cam 14 illustrates the cam in engagement with a selected one valve 20*a* to open the valve.

Housing 24 includes first bore 26. Plunger 28 is movably disposed within bore 26. Plug 30 is threadably engaged within the bore to seal the bottom thereof. Spring 32 generates a force acting on plunger 28 to move the plunger towards plug 30 to thereby reduce the clearance volume between lower surface 29 of plunger 28 and top surface 31 of plug 30. Seal 34 is provided about the plunger to prevent fluid flow upwardly within the bore. As illustrated in FIG. 1, when the plunger is forced upwardly within bore 26, it engages extension member 22 of cam 14 to latch the cam and associated joy stick in a selected one position. When plunger 28 is moved downwardly within bore 26 by the force of spring 32, to assume the dotted line position illustrated in FIG. 1, the top surface of the plunger 35 is spaced from bottom surface 37 of cam extension member 22 so that the plunger does not interfere with the gyratory motion of the cam and associated joy stick. The manner in which the plunger is moved upwardly within the bore to engage extension member 22 to latch the joy stick in a selected one position shall now be more fully explained.

Figure 2:
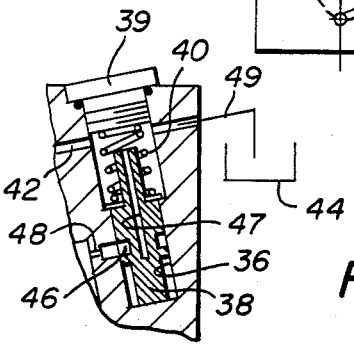
FIG. 2 is an enlarged view of a detail of the valve illustrated in FIG. 1.

A hydraulical actuating system is provided to control the movement of plunger 28 relative to extension member 22. Fluid is delivered via conduit 53 from output 51 of selected one valve 20*a* into second bore 36 provided in housing 24. Spool valve 38 is disposed in second bore 36. Normally, valve 38 is forced downwardly within the bore by spring 40 to vent bore 26 to reservoir 44 (see FIG. 2) and to close off the flow path to the bore from output 51 and conduit 53. Valve 38 includes a first transverse passage 46 communicating with a vertical passage 47. The vertical passage in turn communicates with a transverse passage 42 through housing 24. Passage 42 in turn communicates with conduit 49 which returns fluid from the passage to reservoir 44. Plug 39 is threadably secured within bore 36 to close the top thereof.

In operation, the operator of the earth moving equipment normally rotates the joy stick to open any one of the circular series of valves 20 to obtain a desired machine function. The movement of the joy stick to open selected one valve 20*a* is under control of the operator, and generally, the operator is required to physically maintain the joy stick in position to retain the valve in its open position so long as the function controlled by the valve is desired.

In earth working equipment such as dozers or the like, very often one of the valves 20 controls a function that it may be desired to use on a continuing basis for a prolonged period of time. In such case, to insure that the valve remains open, without requiring the operator to physically hold the joy stick, it is desirable that the joy stick be latched in position to maintain the selected valve 20*a* open. The "float" position of a dozer blade is exemplitive of a machine function of the type under consideration.

During normal operation, plunger 28 is maintained at the bottom of bore 26 by spring 32 whereby the top surface 35 of the plunger is spaced from bottom surface 37 of cam extension member 22, whereat the plunger does not interfere with the gyratory motion of cam 14 and joy stick 12. When the operator desires to open selected one valve 20*a*, e.g. the "float" valve, cam 14 is moved into contact with the valve to depress the stem thereof and open same. In opening valve 20*a*, a hydraulic pressure is established at output 51, resulting in fluid flow through conduit 53 into bore 36. The fluid flow provides a force to overcome the force of spring 40 to move valve 38 upwardly in bore 36 into engagement with plug 39. More definitively, as the stem of valve 20*a* is depressed by cam 14, the pressure at output 51 gradually increases until it obtains a preset threshold value, which provides a fluid force to offset the force of spring 40. The threshold value is obtained immediately prior to the stem moving through its maximum stroke. The upward movement of valve 38 in bore 36 results in fluid flow from the bore through orifice 48 into bore 26. The resultant hydraulic force thus established in bore 26 pushes plunger 28 upward against cam extension 22. The foregoing latches the stem of valve 20*a* at maximum stroke.

When it is desired to delatch cam 14 to close selected one valve 20*a*, the operator may physically move joystick 12 thereby moving plunger 28 downward within bore 26. A quantity of fluid is discharged from bore 26 by the downward movement of plunger 28. As the pressure of the discharged fluid exceeds the pressure of the fluid at outlet 51, the discharged fluid passes through orifice 48, bore 36, conduit 53 and flows into output 51 of valve 20*a*. The increased pressure at outlet 51 results in the stem of valve 20*a* destroking slightly, diminishing the pressure at outlet 20*a*. When the outlet pressure decreases below the threshold value, the spring force of spring 40 exceed the hydraulic force acting on valve 38, moving the valve to its bottom or closed position. The foregoing discontinues communication between orifice 48 and bore 36, and connects bore 26 to reservoir 44 through orifice 48, passages 42, 46 and 47, and conduit 49. With bore 26 in communication with reservoir 44, spring 32 quickly retracts plunger 28 to its bottom or dotted line position which breaks the latch. A return spring (not shown) internal to valve 20*a* ordinarily returns cam 14 and joystick 12 to the FIG. 1 dotted line position (neutral) upon the operator removing his hand from the joystick.

Valve 20*a* may also be delatched by venting bore 26 to reservoir 44 through external conduit 54 under the control of valve 52. Typically, the operation of valve 52 provides a "kick-out" function which may be dictated by the specific requirements of the earth working machine. For example, valve 52 may open when an actuating cylinder obtains its full stroke and it is desirable to deactivate valve 20*a* without deliberate attention from the operator.

Vent conduit 54 and valve 52 provide larger flow passages than does orifice 48. Hence, pressure in bore 26 decreases rapidly to equal the pressure at reservoir 44 when valve 52 is opened. The foregoing results in retraction (downward movement) of plunger 28 and the return of cam 14 to its neutral or dotted line position, with the consequent closing of valve 20*a*. As described previously, with valve 20*a* closed, the pressure at output 51 decreases, enabling spring 40 to retract valve 38. Communication between bores 26 and 36 is thus discontinued and bore 26 is placed in communication with reservoir 44 through orifice 48, passages 42, 46, 47 and conduit 49. It may be noted, valve 52 is usually closed soon after triggering the "kick-out" function.

The incorporation of the present hydraulically actuating detent in pilot valve 10 results in a latching and unlatching mechanism that is positive and responsive, yet one that does not interfere with the gyratory motion of cam 14 and joy stick 12.

Figure 3:
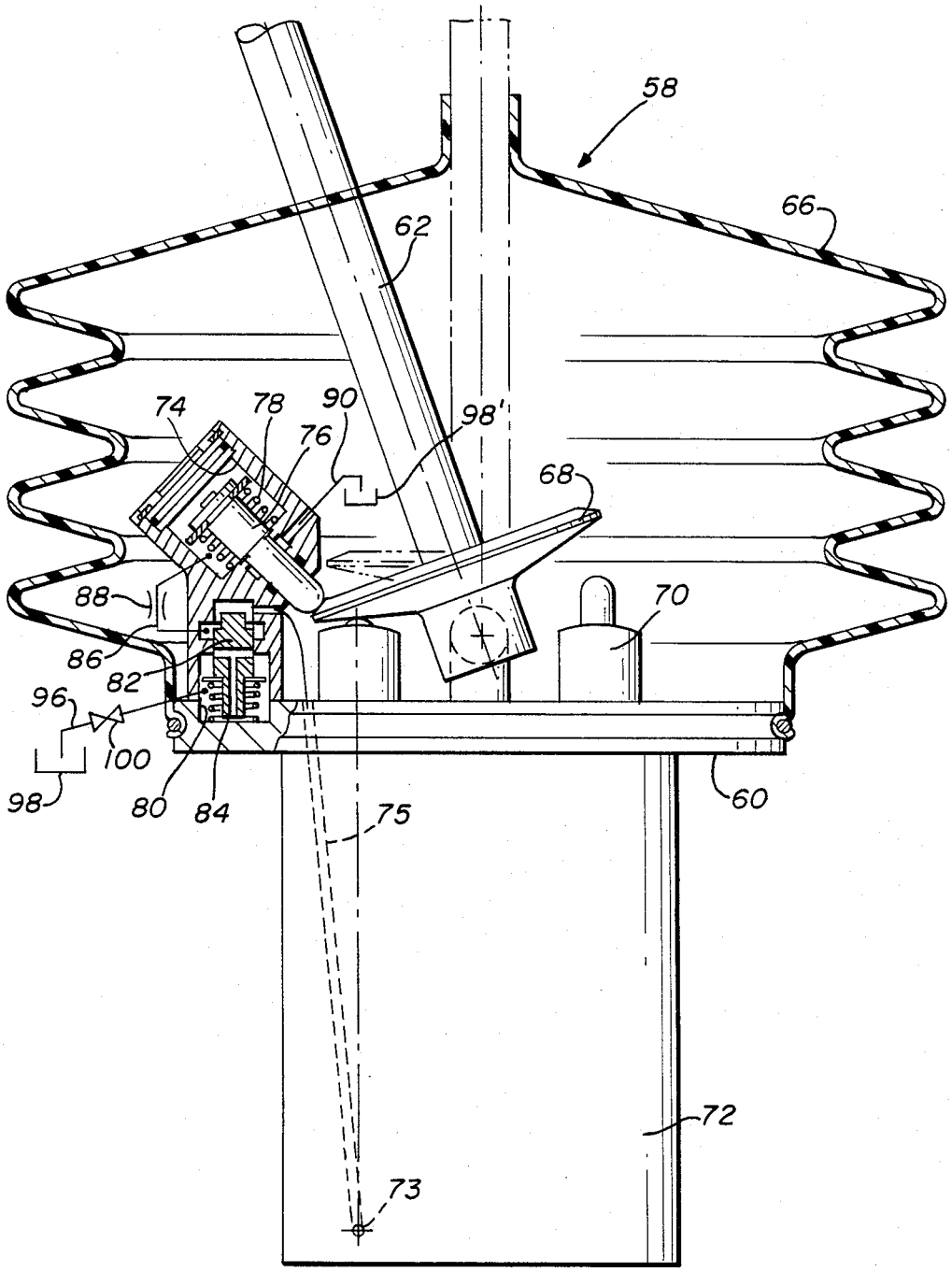
FIG. 3 is a second embodiment of a pilot valve including the detent mechanism of the present invention.

Referring now to FIG. 3 there is illustrated a second embodiment of the present invention. Pilot valve 58 includes a joy stick 62 having a cam 68 attached thereto and movable therewith. A flexible boot 66 is attached to top plate 60 of housing 72. Valve 58 includes a circular series of actuating valves 70 which are selectively opened by movement of cam 68 into contact therewith through operation of joy stick 62. Housing 72 is provided with first and second bores respectively 74 and 80. A plunger 76 extends within within bore 74 and is maintained in a first position by spring 78 whereat plunger 76 is spaced from cam 68.

Spool valve 82 is disposed within bore 80. Spring 84 normally urges valve 82 upwardly within the bore. Conduit 86 communicates bores 80 and 74. An orifice 88 is provided in conduit 86. Conduit 75 delivers fluid from outlet 73 of the selected one valve to provide a hydraulic force acting in opposition to the force provided by spring 84. When the hydraulic force exceeds the spring force, spool valve 82 is moved downwardly within the bore to allow fluid to flow through conduit 86 and orifice 88 into bore 74. The fluid force developed within bore 74, when exceeding the force of spring 78, moves plunger 76 into engagement with cam 68. Cam 68 is thus latched in position. To return plunger 76 to its delatched position, valve 100 is opened to drain fluid through conduit 96 from bore 80. Upon the removal of the hydraulic force, spring 84 returns the valves 82 to its initial position, discontinuing communication between bores 74 and 80. As the hydraulic force acting on valve 82 diminishes, spring 84 forces the valve upwardly within bore 80 to communicate transverse passage 81 and vertical passage 83 with conduit 86. Fluid thus flows from bore 74 to bore 80 and exits therefrom through conduit 96 to reservoir 98.

As the function and operation of valve 58 is identical to that of valve 10, no further explanation is deemed necessary. The hydraulic detent system of the second embodiment is a more compact design than the arrangement disclosed in FIG. 1.

While a preferred embodiment of the present invention has been described and illustrated, the invention should not be limited thereto but may otherwise be embodied within the scope of the following claims.

The embodiments of the invention in which an exclusive property or privilege is claimed are defined as follows:

1. A hydraulically actuated detent for a universally tiltable joy stick of a pilot valve having a circular series of valves arranged about a vertical axis through said pilot valve and selectively operated by movement of said joy stick into engagement therewith for latching said joy stick in a selected one position for actuating one of said valves comprising:

cam means attached to said joy stick and movable therewith;

plunger means spaced from said circular series of valves selectively movable into engagement with said cam means for latching said joy stick in said selected one position and maintaining each of the other of said valves in their deactuated positions independent of the movement of said selected one valve;

hydraulically operated actuating means for moving said plunger means into engagement with said cam means including fluid supplying means for developing a fluid force acting upon said plunger means, to move said plunger means into engagement with said cam means;

valve means responsive to actuation of said selected one valve for controlling the flow of said fluid through said supply means and means for removing the fluid force acting on the plunger means; and plunger return means for disengaging said plunger means from said cam means upon removal of said fluid force for delatching said joy stick.

2. A hydraulically actuated detent in accordance with claim 1 wherein said hydraulic pressure removing means includes a remotely operated valve for bleeding said fluid.

3. A pilot valve including a universally tiltable joy stick, said valve comprising:

a valve housing;

a circular series of valves arranged about a vertical axis through said housing;

cam means attached to said joy stick and movable therewith;

plunger means spaced from said circular series of valves and selectively movable into engagement with said cam means for latching said joy stick in a selected one position for actuating a selected one of said circular series of valves and maintaining each of the other of said valves in their deactuated positions independent of the movement of said selected one valve;

means responsive to actuation of said selected one valve for developing a fluid force acting on said plunger means to move said plunger means into engagement with said cam means including fluid supply means; a spool valve for controlling the flow of fluid through said supply means and means for removing the fluid from said plunger means; and plunger return means for disengaging said plunger means from said cam means upon removal of said fluid force for delatching said joy stick.

4. A pilot valve in accordance with claim 3 wherein said hydraulic pressure removing means includes a remotely operated valve for bleeding said fluid.

5. A pilot valve in accordance with claim 4 wherein said fluid removal means includes an orifice for limiting the flow of fluid towards said plunger means to a rate less than the flow rate of fluid removed from said plunger means.

6. A pilot valve in accordance with claim 3 wherein said fluid removal means includes an orifice for limiting the flow of fluid towards said plunger means to a rate less than the flow rate of fluid removed from said plunger means.

7. A pilot valve including a universally tiltable joy stick, said valve comprising:

a valve housing having first and second radially spaced bores;

a circular series of valves spaced from said first and second bores, and arranged about a vertical axis through said housing;

cam means attached to said joy stick and movable therewith;

a plunger provided in a first one of said bores and selectively movable into engagement with said cam means for latching said joy stick in a selected one position for actuating one of said valves and maintaining each of the other of said valves in their deactuated positions independent of the movement of said selected one valve;

a spool valve disposed in a second one of said bores;

means defining a first flow path including a fluid inlet for supplying fluid into said first bore;

means defining a first drain for providing a second flow path for removing fluid from said first bore;

said spool valve being selectively movable in response to actuation of said selected one valve between first and second positions for respectively blocking said first flow path and opening said second flow path, and opening said first flow path and blocking said second flow path for providing a fluid force acting on said plunger means when the first flow path is open and the second flow path is blocked and means for removing said fluid force from said plunger means when the second flow path is open and said first flow path is blocked, said fluid force acting on the plunger means to move said plunger means into engagement with said cam means; and plunger return means for disengaging said plunger means from said cam means upon removal of said fluid for delatching said joy stick.

* * * * *